US005103198A

United States Patent [19]

Morel et al.

[11] Patent Number: 5,103,198

[45] Date of Patent: Apr. 7, 1992

[54] INSTANTANEOUS TRIP DEVICE OF A CIRCUIT BREAKER

[75] Inventors: Robert Morel, Eybens; Marc Rival, Virieu Sur Bourbe; Hubert Garcia, St. Geoire En Valdeine, all of France

[73] Assignee: Merlin Gerin, France

[21] Appl. No.: 685,634

[22] Filed: Apr. 16, 1991

[30] Foreign Application Priority Data

May 4, 1990 [FR] France ..... 90 05870

[51] Int. Cl.[5] ..... H01H 75/00

[52] U.S. Cl. ..... 335/6; 335/35; 200/144 R

[58] Field of Search ..... 200/147 R, 144 R, 148 R, 200/148 C, 148 A, 148 B; 335/6, 16, 147, 195, 202, 201

[56] References Cited

U.S. PATENT DOCUMENTS 3,631,369 12/1971 Menocal .
4,375,022 2/1983 Daussin et al. ..... 200/144 R
4,878,144 10/1985 Nebon ..... 361/96

FOREIGN PATENT DOCUMENTS 0313422 4/1989 European Pat. Off. .
2452175 10/1980 France .

*Primary Examiner*—Leo P. Picard
*Assistant Examiner*—Lincoln Donovan
*Attorney, Agent, or Firm*—Parkhurst, Wendel & Rossi

[57] ABSTRACT

A limiting circuit breaker with a molded case comprises an overpressure actuator which, when an overpressure occurs in the arc extinguishing chamber due to the action of an arc drawn by the electrodynamic repulsion of the contacts, brings about actuation by a piston, subjected to this overpressure, of the circuit breaker trip bar. The overpressure actuator forms an almost leak-tight assembly.

7 Claims, 3 Drawing Sheets

INSTANTANEOUS TRIP DEVICE OF A CIRCUIT BREAKER

BACKGROUND OF THE INVENTION

The invention relates to a trip device of a molded case electrical circuit breaker having per pole a pair of contacts elastically urged into contact in the closed position of the circuit breaker and capable of separating due to the action of electrodynamic repulsion forces when the current flowing through the contacts exceeds a preset threshold to generate limitation of said current, said trip device having an overload and/or short-circuit fault detector which actuates an automatic opening operating mechanism of the circuit breaker on a fault.

A state-of-the-art trip device (U.S. Pat. No. 3,631,369) of the kind mentioned comprises a movable blade, arranged as a bimetal strip and subjected to the action of the electromagnetic trip device. An extension of the blade protrudes into the gas outflow duct of the arc extinguishing chamber. When breaking occurs the gas flow moves the blade to the tripping position. In most circuit breakers the gas outflow duct is located away from the trip device and the previously mentioned device is therefore not applicable. The blade is subjected to the polluting action of the gases and its correct operation is quickly hindered. Each pole must be equipped with a trip device of this kind and selectivity of tripping is not conceivable for the actuator reacting to the gas flow is integrated in the thermal and magnetic trip device.

The object of the present invention is to achieve a trip device providing both limitation and selectivity of tripping by simple, universal and reliable means.

SUMMARY OF THE INVENTION

The trip device is characterized in that said actuating device constitutes a leaktight assembly only in communication with the contact zone, and having a limited actuating travel.

The pressure in the contact zone, notably in the arc extinguishing chamber, is a direct function of the power of the arc, and can quickly reach high values, for example from 3 to 10 bars. This overpressure acts on a simple membrane or movable piston device which actuates the circuit breaker tripping mechanism. The pressure rise and transmission of this pressure to the detector take place all the more quickly the higher the currents are. The device is however not sensitive to weak currents, and spurious tripping on a simple overload can easily be avoided by providing a return spring of the piston, or of the measuring membrane.

The actuator is a leaktight or almost leaktight assembly constituted by the cylinder with the piston or membrane and the connecting duct between the cylinder and the arc extinguishing chamber. This duct of small cross-section can be relatively long and is easily housed in the case. The movement of the piston only requires a very small gas flow in the duct and this flow takes place almost totally before pollution of the gases due to the action of the arc. The actuator is thus protected from these polluted gases.

High-speed opening of a limiting circuit breaker is not easily compatible with selectivity of tripping which requires opening of the circuit breaker directly upstream from the fault, whereas the other downstream circuit breakers remain closed to ensure continuity of power supply to the sound part of the mains system. It has been attempted to achieve selectivity conditions between two circuit breakers fitted serially, by coordinating their tripping curve, but these conditions are difficult to maintain for the times involved are extremely short. Saturation phenomena often mask measurement of the differences of the currents to be broken, and selectivity is not always achieved.

The present invention is based on the observation that a break in a limiting circuit breaker always generates a high arc voltage, and thereby a notable arc energy resulting in a pressure increase in the breaking zone. This pressure increase is very high-speed, and selectivity can be achieved by using a return spring weighted in such a way as to trip at a preset pressure. Indeed, when two circuit breakers of different ratings have the same short-circuit current flowing through them, the pressure in the upstream circuit breaker is much lower than if it had broken on its own and selectivity is automatically achieved in a particularly simple manner, for only the circuit breaker having the lower rating trips. This selectivity is absolutely independent from the overload and/or short-circuit fault detector, whose design can be adapted to its role of operating on small currents. The action of the fault detector can be slightly delayed in order to avoid any interference with the overpressure actuator, which provides instantaneous protection as soon as it is required.

According to a development of the invention, each pole of a multipole circuit breaker comprises an overpressure actuator, so as to operate as soon as an overpressure occurs in any one of the poles, and to perform tripping as quickly as possible. The piston of the overpressure actuator can be common to the different poles, the latter being connected to the piston by ducts equipped with an anti-return device. The different arc extinguishing chambers are preferably connected to a common manifold with a check valve interposed, this manifold itself being connected by a duct to the piston or membrane of the overpressure actuator, which acts on the circuit breaker trip bar. Tripping on a fault can be obtained by a standard thermal or electromagnetic trip device, or by a solid-state trip device with a polarized relay. All these trip devices and actuators act on the same trip bar which releases the circuit breaker opening mechanism, in a manner well-known to those specialized in the art.

The overpressures are high, and the overpressure actuator can therefore comprise a piston of small surface, in the order of one square centimeter, and this small size makes it easy to house in a molded case, possibly of an existing device.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
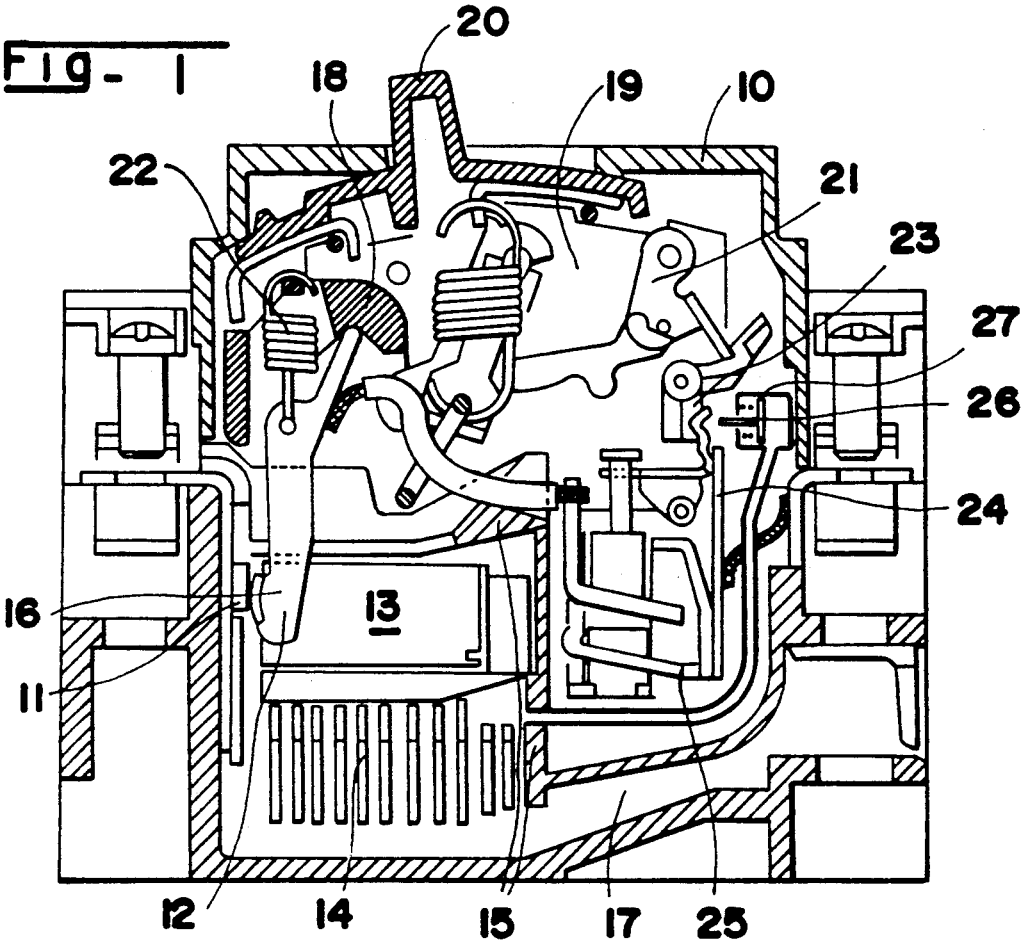
FIG. 1 is a schematic axial section view of a pole of a circuit breaker equipped with an overpressure actuator according to the invention.

In FIG. 1, a pole of a molded case circuit breaker 10 comprises a pair of contacts 11, 12 located in an arc extinguishing chamber 13 equipped with deionization plates 14. The arc extinguishing chamber 13 is bounded by partitions 15 one of which has passing through it a support arm 16 of the movable contact 12. The arc extinguishing chamber 13 is almost leaktight and communicates by a channel 17 of small cross-section with the outside of the molded case 10. The movable contact arm 16 is pivotally mounted on a bar 18 belonging to an operating mechanism 19. having a manual opening and closing handle 20 of the contacts 11, 12 and a latch 21 controling tripping of the mechanism 19. The movable contact 12 is biased by a spring 22 to the closed position, and is capable of pivoting counterclockwise due to the electrodynamic repulsion force generated by the current flowing in the contact arm 16 and contacts 11, 12. The latch 21 is controled by a trip bar 23 common to the different poles of the circuit breaker. The circuit breaker comprises a standard trip device with a bimetal strip 24, and electromagnetic coil 25, both acting on the trip bar 23. A circuit breaker of this kind is well-known to those specialized in the art and does not need to be described in greater detail here. It is sufficient to recall that when a short-circuit occurs, repulsion of the contacts 11, 12 brings about high-speed opening of these contacts, against the force of the spring 22. this high-speed opening causing limitation of the short-circuit current. Opening of the contacts 11, 12 is confirmed by the operation of the electromagnetic trip device 25 acting via the trip bar 23 on the latch 21, which opens the circuit breaker mechanism 19.

Figure 2:
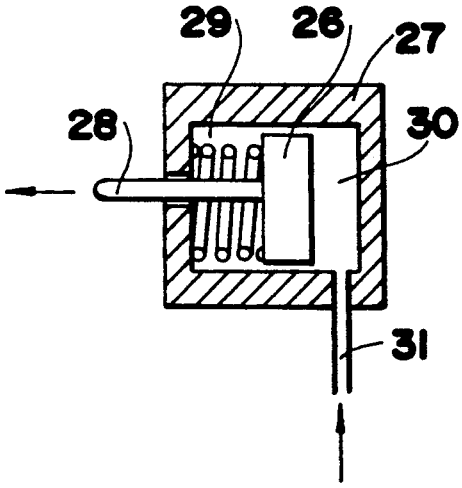
FIG. 2 is an enlarged scale view of the overpressure actuator according to FIG. 1.

According to the present invention, the circuit breaker comprises an overpressure actuator comprising a piston 26 and cylinder 27 assembly cooperating with the trip bar 23. Referring more particularly to FIG. 2, it can be seen that the piston 26 slidingly mounted in the cylinder 27 bears a rod 28 capable of striking the trip bar 23. A return spring 29 keeps the piston 26 in the retracted position, represented in FIG. 2. The face opposite the rod 28 of the piston 26 is subjected to the pressure in the chamber 30 which communicates via a duct 31 with the arc extinguishing chamber 13. In the example represented in FIG. 1, the duct 31 opens onto the chamber 13 in the vicinity of the deionisation plates 14, but pressurization can be performed at any point of the chamber 13, uniformization of the pressure inside this chamber being almost instantaneous.

Operation of the circuit breaker according to the invention is derived from the above description. When the contacts 11, 12 open on a short-circuit, the arc drawn between these contacts produces heating of the gas contained in the arc extinguishing chamber 13 and consequently a pressure increase, as a direct function of the energy of the arc. This pressure increase is transmitted by the duct 31 to the chamber 30, and as soon as this overpressure overrides the force of the return spring 29, causes the piston 26 to slide to the left and actuation of the trip bar 23 causing the mechanism 19 to open, confirming the separation of the contacts. Detection of a strong current arc is extremely fast, whereas the overpressure actuator 26, 27 hardly operates for a normal break or a weak current, the overpressure generated in the arc extinguishing chamber 13 being insufficient to overcome the force of the return spring 29. This same spring 29 enables selectivity to be achieved between two circuit breakers of different ratings having the same short-circuit current flowing through them as the pressure developed will be less great than if it had broken on its own.

The circuit breaker can be multipole and in this case each pole can be equipped with its own overpressure actuator 26, 27 acting on the trip bar 23. When a short-circuit occurs, the most loaded pole causes tripping by the pressure increase in its arc extinguishing chamber 13, this trip causing all the poles of the circuit breaker to open.

Figure 3:
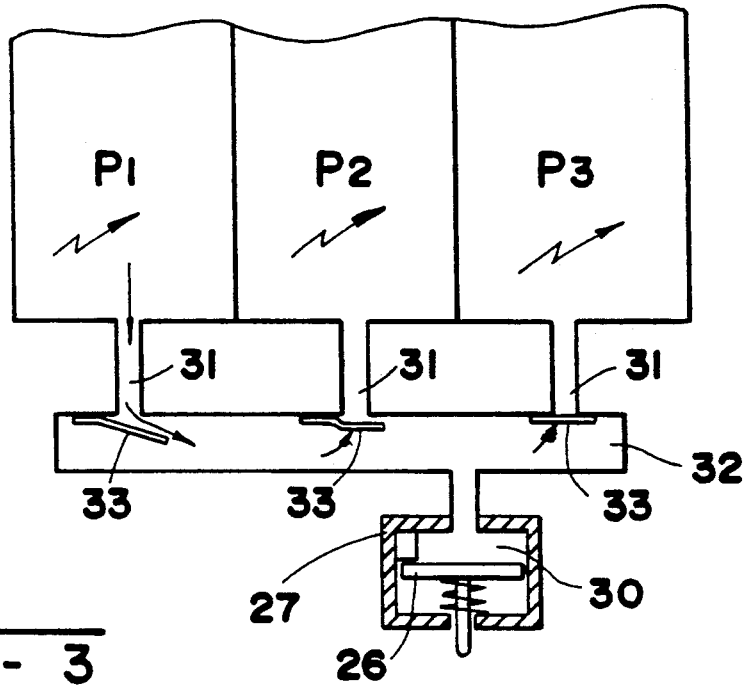
FIG. 3 is a schematic view of the overpressure actuator associated with a three-pole circuit breaker.

According to a preferred embodiment, illustrated by FIG. 3, three poles P1, P2, P3 of a three-pole circuit breaker communicate via ducts 31 with a manifold 32, itself connected to the chamber 30 of the overpressure actuator 26, 27. The orifice via which the ducts 31 enter the manifold 32 is capable of being blocked off by a check valve 33, preventing the gases from flowing from one pole to the other. In the example represented in FIG. 3, the pressure increase in the arc extinguishing chamber of the first pole P1 is the quickest, and this pressure is transmitted via the duct 31 and manifold 32 to the overpressure actuator 26, 27, the valve 33 being open. The other two poles P2, P3 are isolated from the manifold 32 by closing of their corresponding valve 33, and the actuating device remains almost leaktight.

Figure 4:
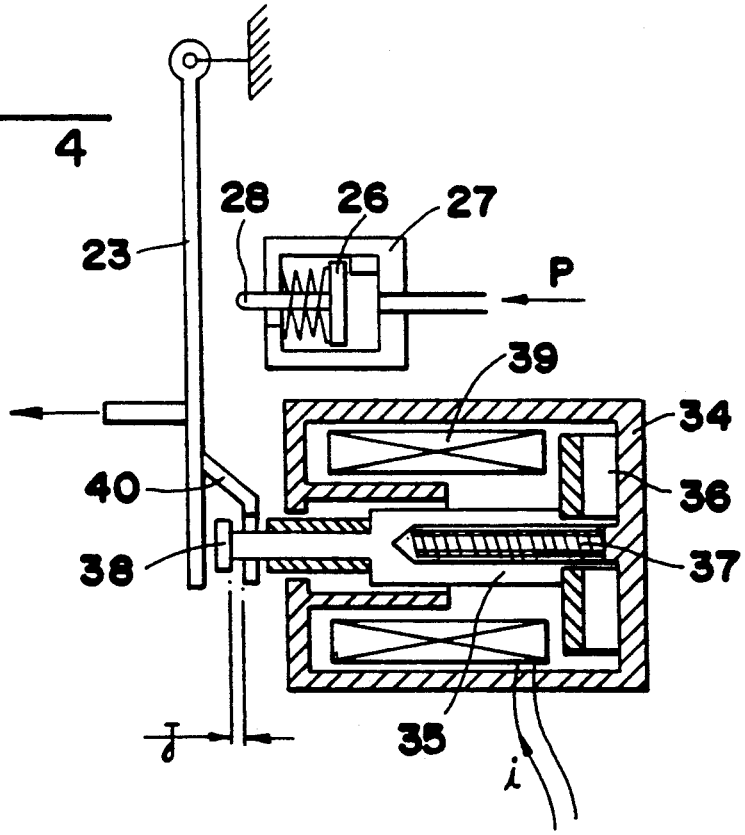
FIG. 4 is a schematic sectional view of an overpressure actuator associated with a polarized relay of a solid-state trip device.

The invention is applicable to circuit breakers with solid-state trip devices using current transformers to detect an overload or short-circuit. These current transformers supply a signal to an electronic processing device which delivers a tripping order to a polarized relay 34 when preset thresholds are exceeded. Referring to FIG. 4, it can be seen that the polarized relay 34 comprises a plunger core 35 held in the retracted position by a permanent magnet 36, and biased to the operating position of the trip bar 23, by means of a push-rod 38, by a spring 37. The tripping order is transmitted to a coil 39 which releases the core 35. The overpressure actuator 26, 27 is adjacent to the polarized relay 34 and the rod 28 is located facing the trip bar 23 to actuate the latter when an overpressure occurs. The trip bar 23 bears a lug 40, capable of cooperating with the rear face of the head of the push-rod 38, leaving a clearance "j", sufficient for movement of the trip bar 23 due to the action of the overpressure actuator 26, 27, without the core 35 of the relay 34 moving. This lug 40 causes discharging of the polarized relay 34 after the mechanism 19 has tripped.

Operation of the circuit breaker with solid-state trip device is naturally identical to that described above with a standard trip device. In both cases, the high-speed operation of the overpressure actuator allows a small time delay of the trip device on a fault, this time delay being able to be obtained by a simple clearance between the electromagnetic trip device and the trip bar, or between the polarized relay 34 and this trip bar 23. Any other delay means, for example of the runner type can be used.

Figure 5:
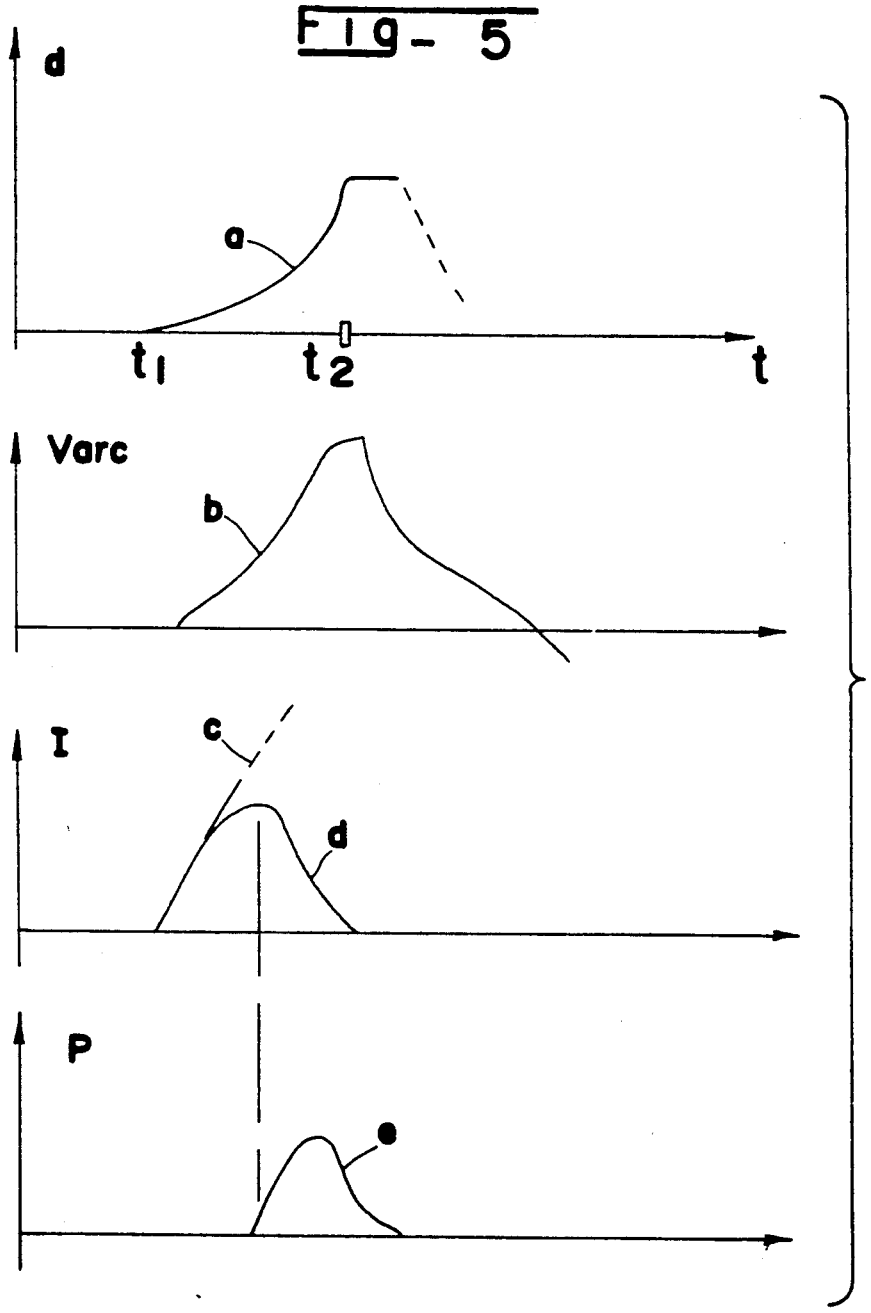
FIG. 5 represents the variation curves of the tripping characteristics.

The curves in FIG. 5 show the mode of action of the trip device according to the invention. Curve "a" shows the separation distance of the contacts 11, 12, on opening on a short-circuit by electrodynamic repulsion of the movable contact 12. Curve "b" shows the variation of the arc voltage corresponding to opening of the contacts 11, 12. Curve "c" illustrates the increase of the presumed short-circuit current, whereas curve "d" corresponds to the current limited by the electrodynamic repulsion of the contacts 11, 12. Curve "e" shows the pressure variation in the arc extinguishing chamber 13. Separation of the contacts 11, 12 takes place at a time "t1" and the overpressure actuator causes opening of the machanism 19, and thereby that of the three poles of the circuit breaker at a time "t2" confirming opening of the contacts by electrodynamic repulsion. A piston 26, with a diameter of 10 mm, has enabled amply sufficient forces to be obtained to actuate the trip bar 23. A piston of this size can easily be housed in the molded case 10, and the duct 31 of small cross-section enables the pressure to be picked up at any point of the arc extinguishing chamber 13. The usual leaktightness of the arc extinguishing chambers 13 is amply sufficient to obtain the necessary overpressures, and it is not necessary to provide additional leaktightness means of these chambers. The assembly is particularly simple and selectivity is obtained by using return springs 29 of suitable size.

We claim:

1. An electrical circuit breaker comprising a molded case, having an arc extinguishing chamber, a pair of contacts housed in said arc extinguishing chamber, elastic means urging the contacts to the closed position, said contacts being capable of separating due to the action of electrodynamic repulsion forces when the current flowing through the contacts exceeds a preset threshold to generate limitation of said current, an opening and closing operating mechanism of said contacts, an overload and/or short-circuit fault trip device which actuates said operating mechanism, and an actuating device formed by a leaktight assembly having a duct communicating with said arc extinguishing chamber and a part reacting to the pressure transmitted by said duct and actuating said operating mechanism when said pressure exceeds a preset threshold.

2. The electrical circuit breaker according to claim 1, having deionization plates and wherein said arc extinguishing chamber is partially leaktight and contains said pair of contacts and said plates.

3. The circuit breaker according to claim 1, wherein said actuator comprises a movable part such as a piston or membrane subjected to said pressure, and a weighted return device acting on said movable part, whose movement causes said circuit breaker opening mechanism to be actuated, said weighted return device being arranged to avoid spurious actuation on a simple overload or when a short-circuit occurs broken by another circuit breaker.

4. A multipole circuit breaker according to claim 1, wherein each pole cooperates with an actuating device to bring about opening of the multipole circuit breaker when the pressure in any one of said poles exceeds said threshold.

5. The circuit breaker according to claim 4, wherein the actuating device comprises a movable part subjected to said pressure and common to all the poles and ducts equipped with an anti-return device connecting said movable part to the arc extinguishing chamber of each pole.

6. The circuit breaker according to claim 5, having a manifold common to all the poles and communicating with the arc extinguishing chamber of each of the poles via ducts equipped with check valves, said movable part being connected to said manifold.

7. The circuit breaker according to claim 1, wherein said fault trip device comprises a thermal element and/or an electromagnetic element through which the current flows and a trip bar on which said elements and said actuating device act, the action of the fault trip device being time delayed with respect to that of the actuating device so as to provide selectivity of tripping.

* * * * *